US005854966A

United States Patent [19]

Kampe et al.

[11] Patent Number: 5,854,966

[45] Date of Patent: Dec. 29, 1998

[54] METHOD OF PRODUCING COMPOSITE MATERIALS INCLUDING METALLIC MATRIX COMPOSITE REINFORCEMENTS

[75] Inventors: Stephen L. Kampe, Alum Ridge, Va.; Leontios Christodoulou, London, England

[73] Assignee: Virginia Tech Intellectual Properties, Inc., Blacksburg, Va.

[21] Appl. No.: 909,651

[22] Filed: Aug. 12, 1997

Related U.S. Application Data

[62] Division of Ser. No. 448,858, May 24, 1995, Pat. No. 5,744,254.

[51] Int. Cl.[6] ..... B22F 3/20

[52] U.S. Cl. ..... 419/67; 419/69

[58] Field of Search ..... 419/66, 67, 69

[56] References Cited

U.S. PATENT DOCUMENTS

| | | | |
|---|---|---|---|
| 2,994,947 | 8/1961 | Towner et al. | 29/182 |
| 3,004,331 | 10/1961 | Towner et al. | 75/123 |
| 3,525,607 | 8/1970 | Holtz | 75/123 |
| 4,093,454 | 6/1978 | Saito et al. | 75/236 |
| 4,710,348 | 12/1987 | Brupbacher et al. | 420/129 |
| 4,738,389 | 4/1988 | Moshier et al. | 228/198 |
| 4,751,048 | 6/1988 | Christodoulou et al. | 420/129 |
| 4,756,754 | 7/1988 | SinghDeo | 75/233 |
| 4,772,452 | 9/1988 | Brupbacher et al. | 420/129 |
| 4,774,052 | 9/1988 | Nagle et al. | 420/129 |
| 4,800,065 | 1/1989 | Christodoulou et al. | 420/129 |
| 4,836,982 | 6/1989 | Brupbacher et al. | 420/129 |
| 4,915,902 | 4/1990 | Brupbacher et al. | 420/129 |
| 4,915,903 | 4/1990 | Brupbacher et al. | 420/129 |
| 4,915,905 | 4/1990 | Kampe et al. | 420/418 |
| 4,915,908 | 4/1990 | Nagle et al. | 420/590 |
| 4,916,029 | 4/1990 | Nagle et al. | 428/614 |
| 4,916,030 | 4/1990 | Christodoulou et al. | 428/614 |
| 4,917,964 | 4/1990 | Moshier et al. | 428/614 |
| 4,921,531 | 5/1990 | Nagle et al. | 75/351 |
| 4,968,348 | 11/1990 | Abkowitz et al. | 75/244 |
| 4,985,202 | 1/1991 | Moshier et al. | 420/590 |
| 5,006,417 | 4/1991 | Jackson et al. | 428/614 |
| 5,015,534 | 5/1991 | Kampe et al. | 428/570 |
| 5,030,277 | 7/1991 | Eylon et al. | 75/229 |
| 5,032,353 | 7/1991 | Smarsly et al. | 419/12 |
| 5,059,490 | 10/1991 | Brupbacher et al. | 428/614 |
| 5,066,618 | 11/1991 | Kantner et al. | 75/230 |
| 5,093,148 | 3/1992 | Christodoulou et al. | 427/37 |
| 5,114,505 | 5/1992 | Mirchandani et al. | 75/235 |
| 5,137,565 | 8/1992 | Thelin et al. | 75/238 |
| 5,246,480 | 9/1993 | Haufe et al. | 75/244 |
| 5,256,183 | 10/1993 | Ruch et al. | 75/230 |
| 5,279,191 | 1/1994 | Buljan | 75/235 |
| 5,308,376 | 5/1994 | Oskarsson et al. | 75/238 |
| 5,354,351 | 10/1994 | Kampe et al. | 75/244 |
| 5,409,518 | 4/1995 | Saito et al. | 75/44 |
| 5,409,661 | 4/1995 | Imahashi et al. | 419/10 |
| 5,460,640 | 10/1995 | Buljan | 419/19 |
| 5,460,775 | 10/1995 | Hayashi et al. | 419/19 |
| 5,482,673 | 1/1996 | Alexander et al. | 419/14 |

*Primary Examiner*—Ngoclan Mai
*Attorney, Agent, or Firm*—Alan G. Towner; Eckert Seamans Cherin & Mellott, LLC

[57] ABSTRACT

Composite materials are disclosed comprising a continuous matrix with composite reinforcements therein. The composite materials may include a continuous metal, metal alloy or intermetallic matrix with intermetallic matrix composite reinforcements dispersed therein. Suitable metals for the continuous matrix include Al, Ti, Cu and Fe, and alloys and intermetallics thereof. The composite reinforcements comprise ceramic particles dispersed in a continuous intermetallic matrix. Suitable intermetallics include alumnides of Ti, Cu, Ni, Mg and Fe, while suitable ceramics include refractory metal borides, carbides, nitrides, sulicides and sulfides. In one embodiment, the ceramic particles are formed in-situ within the intermetallic matrix of the composite reinforcements. The composite materials are produced by powder metallurgical techniques wherein powders of the continuous matrix component and powders of the composite reinforcement are blended and consolidated. The composite materials may be subjected to deformation processes such as extruding, rolling and forging during or after the consolidation step to provide materials with improved properties.

4 Claims, 6 Drawing Sheets

METHOD OF PRODUCING COMPOSITE MATERIALS INCLUDING METALLIC MATRIX COMPOSITE REINFORCEMENTS

This is a division of U.S. application Ser. No. 08/448,858 filed May 24, 1995 U.S. Pat. No. 5,744,254.

FIELD OF THE INVENTION

The present invention relates to composite materials comprising a continuous matrix with composite reinforcements therein. More particularly, the invention includes composite materials having a continuous metallic matrix with intermetallic matrix composite reinforcements dispersed therein. The invention also relates to a method for producing such composite materials.

BACKGROUND OF THE INVENTION

Metal matrix composites comprising discontinuous ceramic reinforcements are under consideration for an increasing number of applications. Such composites have been highly touted as efficient material alternatives to conventional ferrous and nickel-base alloys presently incorporated in high performance, high temperature applications. Prominent among those who have invested heavily in the field are the automotive and aerospace industries, in efforts to improve fuel efficiency and performance. Other industries with interest in metal matrix composites include heavy equipment manufacturers and tooling industries such as drilling, mining and the like.

The successful implementation of metal matrix composites has been hindered by two inter-related phenomena. First, there is a significant lack of appropriate reinforcing compounds. In prior art composites there is the tendency for the metal/ceramic pair to react chemically, thus forming unwanted and mechanically-inferior reaction products. Unlike polymeric materials currently utilized as matrices in commercial composite materials, metallic materials are inherently reactive and thus almost always form deleterious reaction products during the high temperatures required for their processing, or during exposure to the elevated temperatures characteristic of their eventual use environment.

Secondly, high strength ceramic reinforcements are difficult to produce in a form which can impart strengthening via composite principles to a metallic matrix. Those that can be successfully produced are presently prohibitively expensive due to the rigorous processing required and/or their tendency to react with the metallic matrices of interest.

One metal/ceramic composite material that has experienced limited use is aluminum reinforced with silicon carbide particles. However, a major disadvantage of such composite materials is that the SiC particles are not thermodynamically stable within the Al matrix and form deleterious reaction products such as $Al_4C_3$. To combat this instability, Si has been added as an alloying addition to the aluminum matrix. However, such Si additions detrimentally effect the strength of the aluminum matrix. Furthermore, the chemical instability and other processing constraints of the SiC particles restrict their use to relatively low volume percentages such as 15 volume percent or less.

Conventional metal/ceramic composite materials are typically formed by powder metallurgical techniques wherein particles of the matrix metal are mixed with particles of the ceramic, followed by sintering. Alternatively, attempts have been made to form metal/ceramic composites by dispersing the ceramic particles in a molten bath of the matrix metal.

A more recent method for producing metal/ceramic composites involves the in-situ formation of ceramic particles such as borides, carbides and nitrides in a metallic matrix. Such in-situ formation techniques are disclosed in U.S. Pat. Nos. 4,710,348, 4,751,048, 4,772,452, 4,774,052, 4,836,982, 4,915,902, 4,915,903, 4,915,905, 4,915,908, 4,916,029, 4,916,030, 4,917,964, 4,985,202, 5,015,534 and 5,059,490, each of which is incorporated herein by reference.

SUMMARY OF THE INVENTION

An object of the present invention is to provide a novel composite material.

Another object of the present invention is to provide an improved composite material comprising a continuous matrix with intermetallic matrix composite reinforcements.

Another object of the present invention is to provide an improved composite material comprising a continuous metallic matrix with composite reinforcements dispersed therein, the composite reinforcements comprising a metallic matrix having a lower melting temperature than the continuous metallic matrix of the composite material.

Another object of the present invention is to provide an improved composite material comprising a continuous matrix with composite reinforcements, the reinforcements comprising a metal, metal alloy or intermetallic matrix having in-situ formed ceramic particles therein.

Another object of the present invention is to provide an improved composite material comprising a continuous metal matrix with metallic or intermetallic matrix composite reinforcements having defined morphologies.

Another object of the present invention is to provide an improved deformation-processed composite material comprising a continuous metallic matrix with composite reinforcements.

Another object of the present invention is to provide a method for producing improved composite materials comprising a continuous metallic matrix with composite reinforcements.

Another object of the present invention is to provide an improved method for making composite materials utilizing particulate composite material as a reinforcement in a continuous metallic matrix.

These and other objects of the present invention will become more readily understood by consideration of the following description.

DETAILED DESCRIPTION OF THE PREFERRED EMBODIMENTS

Figure 1:
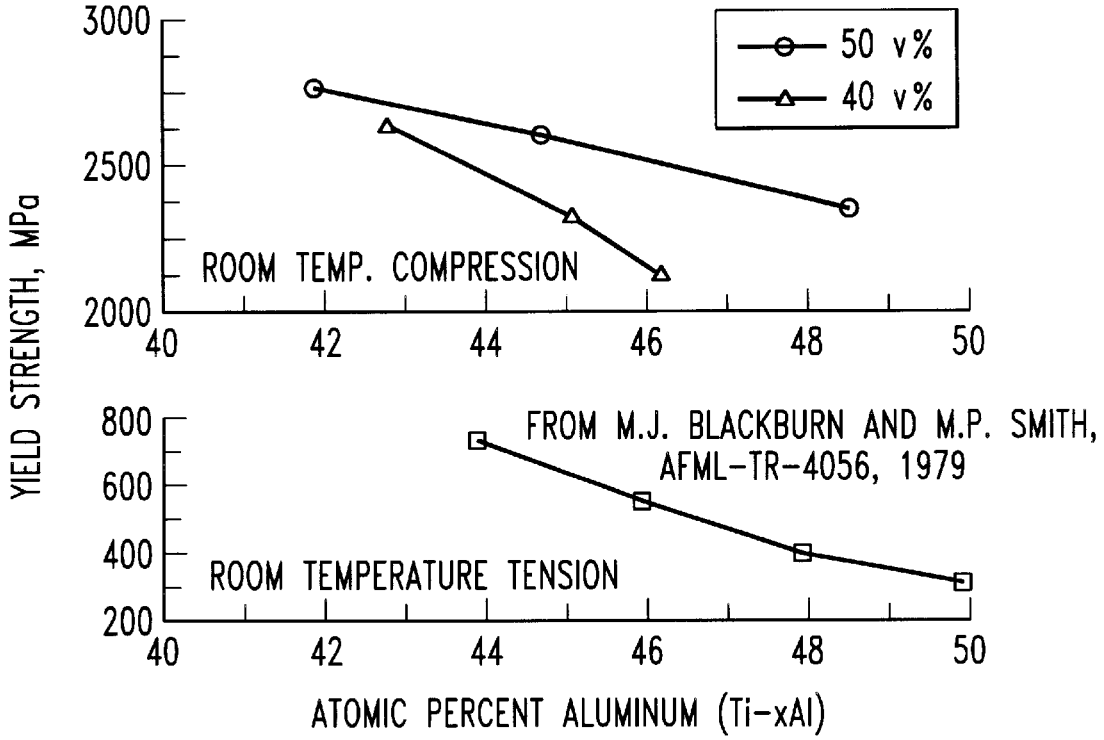
FIG. 1 illustrates the retention of flow behavior characteristics for an intermetallic matrix composite reinforcement material of the present invention in comparison with a monolithic intermetallic material.

The composite materials of the present invention comprise a continuous matrix and a composite reinforcement phase. The continuous matrix may comprise any suitable metallic or polymeric material. Preferably, the continuous matrix comprises a metal, metal alloy or intermetallic material, with high strength engineering alloys being more preferred. In the most preferred embodiment, the continuous matrix comprises a lightweight, high strength engineering alloy that can be processed by casting and powder metallurgical and deformation processing techniques.

Suitable metals for the continuous matrix include Al, Ti, Ni, Cu. Fe, Mg, Be, Nb, Co, Zr, Ta, Mo and W, along with alloys and intermetallics thereof. Exemplary high purity metals include Aluminum Association (AA) 1XXX series alloys and commercially pure Ti (CP Ti). Exemplary metal alloys for the continuous matrix include Al alloys such as AA 2XXX, 5XXX and 7XXX series alloys, Ti alloys such as, in weight percent, Ti-6Al-4V, Ti-13V11Cr-3Al, Ti-8Al-1Nb-1V and β-21S (Ti-15Mo-2.7Nb-3Al-0.2Si) and Ni alloys such as Alloy 200. Suitable intermetallic compounds for the continuous matrix include aluminides and sulicides of metals such as Ti, Cu, Ni and the like.

Titanium-based alloys are suitable as the continuous matrix in accordance with the present invention, particularly for applications requiring both high strength and light weight, e.g., aerospace, automotive, and sporting goods industries. These Ti alloys are capable of strengths comparable to those exhibited by advanced ferrous- and nickel-based superalloys, but at approximately half the density and component weight. The titanium matrix composites of the present invention are also useful at high temperatures, e.g., at temperatures from approximately 500° C. through 800° C., a temperature range currently heavily served by nickel-based superalloys. In the past, Ti has not been successfully used as a matrix material because it is extremely reactive with essentially all ceramic based reinforcements.

In accordance with one preferred embodiment of the present invention, Ti alloys are reinforced with near-γ titanium aluminide intermetallics (nearly stoichiometric TiAl comprising from about 40 to about 56 atomic percent Al) with high loadings of $TiB_2$ which possess properties comparable to those of $Al_2O_3$ and SiC ceramics. The near-γ intermetallic matrix composite reinforcements are thermodynamically stable with conventional α/β titanium alloys such as the commercially dominant Ti-6Al -4V alloy. The near-γ matrix of the reinforcement is strong and ceramic-like to temperatures of approximately 700° C. At higher temperatures it becomes ductile and deformation-processable. It is noted that the aluminide intermetallic matrix has a melting temperature lower than that of the titanium matrix within which it will be placed, meaning that it can advantageously be processed at higher homologous temperatures than that of the titanium matrix, as more fully described below.

Aluminum-based alloys are also suitable as the continuous matrix of the present composites, particularly for high performance materials in the aerospace, automotive and sporting goods industries due to their low density and resultant high-strength-to-weight ratio. While utilization of conventional aluminum alloys is currently limited to moderate temperatures (T<350° C.) due to the mechanistic nature of their strengthening, the aluminum matrix composites of the present invention are useful at both ambient and elevated temperatures up to about 500° C.

For example, a composite with a continuous matrix comprised of a high strength AA 2XXX series Al—Cu alloy and discontinuous composite reinforcements represents a surprisingly improved high performance metal matrix composite in accordance with the present invention. For instance, reinforcements comprising an intermetallic matrix of approximately stoichiometric $Al_2Cu$, which resides in thermodynamic equilibrium with the Al—Cu continuous matrix, produce highly improved properties in accordance with the present invention. Synthesizing an intermetallic matrix composite from this compound, e.g., $Al_2Cu$+20–60 volume % $TiB_2$, $ZrB_2$, TiC, etc. creates an unexpectedly improved reinforcement phase for the 2XXX series alloys, and creates the potential for higher temperature applications than currently possible.

In a similar manner, high strength ferrous-based composites can be produced in accordance with the present invention by the incorporation of, e.g., FeAl+TiC intermetallic matrix composite reinforcements within the iron-based matrix.

Furthermore, high strength copper-based composites can be produced by incorporating reinforcements comprised of, e.g., Cu+$TiB_2$ within the Cu matrix. Such Cu-based composites possess high strength capabilities as well as high thermal and electrical conductivities.

The discontinuous composite reinforcement phase of the present invention preferably comprises a metal, metal alloy or intermetallic matrix with ceramic particles dispersed therein. In accordance with the most preferred embodiment, the matrix of the reinforcement comprises an intermetallic. However, it is to be understood that metals and metal alloys are also suitable as the matrix of the reinforcement phase.

Intermetallics that exhibit the favorable properties of high strength and high hardness at ambient temperatures, high ductility and processability at elevated temperatures, and thermodynamic or kinetic stability with the continuous matrix of the final composite are preferred. In the preferred embodiment of the present invention, the melting temperature of the intermetallic is less than that of the continuous metal matrix within which it will reside. Thus, the intermetallic matrix composite reinforcement may be co-processed with the continuous metal matrix of the final composite at higher homologous temperature, thereby assuring co-processability despite the presence of the ceramic strengthening agents within the intermetallic matrix composite. This is in contrast with conventional high melting temperature ceramic reinforcements which have been used in an attempt to achieve improved high temperature strengths.

Suitable intermetallics include aluminides such as aluminides of Ti, Cu, Ni, Mg, Fe and the like. Preferred intermetallics include TiAl, $TiAl_3$, $Al_3Ti$, $Cu_2Al$, NiAl, $Ni_3Al$, $TaAl_3$, TaAl, FeAl, $Fe_3Al$ and $Al_3Mg_2$. In accordance with the present invention, the use of an intermetallic matrix in the reinforcement phase results in highly improved properties in the final composite, and provides unexpectedly improved processability in comparison with conventional composite materials. The intermetallic matrix of the composite reinforcement phase is preferably selected such that it is thermodynamically stable with respect to the continuous matrix of the final composite. Thus, the intermetallic matrix is stable during the composite formation and fabrication process, and is stable during use of the final composite material at both ambient and elevated temperatures.

The use of intermetallic matrix composites as reinforcements in accordance with the present invention provides the ability to independently tailor thermodynamic stability of the reinforcing phase and its mechanical properties. Stability within the continuous metallic matrix of the final composite is governed by the choice of the intermetallic phase constituting the matrix of the intermetallic matrix composite. Mechanical properties (strength, modulus, ductility) of the reinforcing phase are primarily determined by the loading of ceramic reinforcement incorporated into the intermetallic matrix, as more fully described below.

The present invention provides the ability to utilize the unique properties of intermetallics to impart both property and processing advantages. At low to moderate temperatures, the intermetallic matrix of the reinforcement possess properties comparable to ceramic-based reinforcements. At elevated temperatures, the intermetallic matrix composites become ductile and hence processable by conventional metallurgical fabrication techniques. For example, deformation-based processing techniques such as extrusion, forging and rolling are possible and can be used to impart favorable morphological and/or microstructural benefits to the intermetallic. As such, the composite reinforcements of the present invention provide the ability to impart a broad range of geometric microstructural variants which are important in providing advantageous properties in the final composite material. For example, the aspect ratio, spacing, residual stress distribution, coefficient of thermal expansion and degree of alignment of the reinforcements can all be varied in order to provide the desired properties.

In accordance with the present invention, the ceramic particulates of the reinforcement composite are preferably transition metal borides, carbides, nitrides, silicides and sulfides. Refractory metal borides and carbides such as $TiB_2$, $ZrB_2$, $NbB_2$, $TaB_2$, $HfB_2$, $VB_2$, TiB, TaB, VB, TiC, TaC, WC, HfC, VC, MoC, TaC and $Cr_7C_3$ may be used, with $TiB_2$ being particularly preferred for many applications. Suitable sulicides include $Ti_5Si_3$, $V_5Si_3$ and $Ta_5Si_3$, while suitable nitrides include TiN, AlN, HfN and TaN. Preferred ceramics possess very high melting temperatures, e.g., borides, carbides, silicides and nitrides of refractory metals, and metalloids such as SiC, $B_4C$, BN and the like.

The composite reinforcements may be made by conventional powder metallurgical techniques. However, in the preferred embodiment, the composite reinforcements comprise ceramic particles that have been formed in-situ within the metal, metal alloy or intermetallic matrix of the composite. For example, the ceramic may comprise a refractory metal boride and/or carbide formed in-situ within an aluminum or aluminide matrix. The compositions of suitable in-situ formed composites are disclosed in U.S. Pat. Nos. 4,710,348, 4,751,048, 4,772,452, 4,774,052, 4,836,982, 4,915,902, 4,915,903, 4,915,905, 4,915,908, 4,916,029, 4,916,030, 4,917,964, 4,985,202, 5,015,534 and 5,059,490, cited previously.

The ceramic of the reinforcement phase may be of various morphologies such as equiaxed particles (aspect ratio approximately 1:1), rods (aspect ratio from about 2:1 to about 10:1), platelets (aspect ratio greater than about 2:1), whiskers (aspect ratio greater than about 10:1), high aspect ratio fibers and the like, over a broad range of sizes, for example, as disclosed in the above-referenced patents.

The ceramic particulates of the reinforcement composite may range in size from less than 0.01 micron to a size approaching the overall particle size of the reinforcement composite. Preferably, the average particle size of the ceramic ranges from about 0.1 micron to about 40 micron, and more preferably from about 0.1 to about 10 micron. In the case of whisker-shaped ceramics, the average diameter may range from about 0.05 to about 10 micron, with the average length ranging from about 5 to about 100 micron.

The volume percentage of ceramic in the composite reinforcement may range from less than 0.01 volume percent to greater than 75 volume percent. Preferably, the ceramic ranges from about 10 to about 60 volume percent of the composite reinforcement. Within this preferred range the ceramic is present to an extent as to impart strengthening to the metallic or intermetallic matrix of the reinforcement, and is present such that the individual ceramic particles are microstructurally isolated from one another by a continuous metallic matrix. More preferably, the ceramic comprises from about 30 to about 60 volume percent of the composite reinforcement. In accordance with the present invention, the ceramic particulates preferably impart high strengthening to the reinforcement composite while providing suitable processability. In general, higher ceramic loadings provide higher strengthening while lower ceramic loadings provide improved processability. Thus, the ratio of ceramic to metallic/intermetallic matrix may be varied over a wide range of values depending on the desired properties and processability for a given system.

In order to demonstrate the advantageous properties of the intermetallic composite matrix reinforcements of the present invention, Table I illustrates compressive properties for a series of near-γ titanium aluminide matrices reinforced with relatively high loadings, i.e., about 30–60 volume percent, of discontinuous $TiB_2$ particles. Also shown for comparison are properties of the two monolithic structural ceramics, $Al_2O_3$ and SiC, that are most frequently mentioned as candidate reinforcements for metallic matrices.

TABLE I

Example Properties of $TiB_2$-reinforced Near-γ Titanium Aluminides Versus Conventional Ceramic Materials

| Material | σ fracture compression (MPa) | Elastic Modulus (GPa) | σ fracture tension (GPa) | Hardness (1 kg Knoop) |
|---|---|---|---|---|
| TiAl + 30 v % $TiB_2$ | 2100[2] | 278[2] | 725[2] | 8.6[2] |
| TiAl + 40 v % $TiB_2$[1] | 2344[3] | 290[3] | 700[2] | 9.0[3] |
| TiAl + 50 v % $TiB_2$[1] | 2620[3] | 305[3] | 400[2] | 9.5[3] |
| TiAl + 60 v % $TiB_2$ | 2900[2] | 330[2] | 250[2] | 10.0[2] |
| $Al_2O_3$ (AD-94) | 2103[4] | 303[4] | 193[4] | 10.7[4] |
| SiC | 2500[4] | 393[4] | 307[4] | 24.5[4] |

Notes:
[1]Ti—45Al + $TiB_2$ (HIPed).
[2]Measured.
[3]Estimated, based on extrapolation of measured data.
[4]Materials Standard 990. Coors Ceramic Company, 1989.

As shown in Table I, the room temperature properties of the $TiB_2$ reinforced titanium aluminides exhibit strength and elastic modulus values comparable to that of either structural ceramic. Unlike the $Al_2O_3$ and SiC, however, the titanium aluminide composite is capable of significant plastic deformation at elevated temperatures. The transition from brittle to ductile behavior of near-γ titanium aluminide compositions occurs at temperatures of approximately 650° C., varying slightly within a range of about ±25° C. with specific alloy compositions. The addition of $TiB_2$ to the titanium aluminide matrix elevates the flow stress at temperatures below the ductile-to-brittle transition (DBTT) and, depending upon the strain rate employed, generally at temperatures above the DBTT as well. The temperature at which the DBTT occurs remains substantially unchanged with $TiB_2$, reinforcement. Thus, processability is maintained for various loadings of $TiB_2$ in the intermetallic. FIG. 1 illustrates that despite relatively high loadings of $TiB_2$, within these matrices, the flow behavior characteristics of the monolithic intermetallic composition is qualitatively retained.

In accordance with the present invention, the relative proportions of the continuous matrix of the final composite to the composite reinforcement phase may vary widely. The amount of composite reinforcement may range from less than 0.01 volume percent to more than 90 volume percent of the final composite material. Preferably, the composite reinforcement ranges from about 10 to about 60 volume percent of the composite. More preferably, the composite reinforcement ranges from about 20 or 30 to about 60 volume percent of the final composite. The composite reinforcement is preferably present to an extent as to impart strengthening to the continuous matrix, while preserving a substantial portion of the ductility, toughness and processability of the continuous matrix. Thus, the amount of composite reinforcement is selected as to impart the desired degree of strengthening to the continuous matrix, while providing adequate processability.

Some exemplary composite systems of the present invention include β-Ti-phase-containing titanium alloys, e.g., Ti-6Al-4V or β-21S, as the continuous matrix reinforced with an intermetallic-containing composite comprising a continuous matrix of near-γ Ti-47Al having about 50 volume percent $TiB_2$ dispersed therein. The matrix of the intermetallic-containing reinforcement composite exhibits an approximate melting temperature of 1480° C., as compared with approximately 1660° C. for the Ti-6Al-4V continuous matrix. The differential in melting temperatures assures that co-deformability will occur at a determinable temperature less than that of the continuous matrix. Thus, a final composite material is provided that exhibits superior properties and ease of processability. Furthermore, the β-Ti microstructure exhibits thermodynamic stability with the Ti—Al intermetallic matrix of the reinforcement.

As a further example, the intermetallic matrix of the composite reinforcement may be $Al_3Ti$, which is characterized by a lower melting temperature than near-γ TiAl. The use of $Al_3Ti$ provides additional processing flexibility by facilitating co-deformability, cosintering and densification. The $Al_3Ti$ intermetallic matrix may be alloyed with various alloying elements to depress its melting temperature even further. Suitable alloying elements include Cu, Mn and/or Fe.

As an example of a reinforced aluminum alloy of the present invention, an AA 2XXX series Al—Cu alloy may be reinforced with an intermetallic matrix reinforcement composite comprising a matrix of $Al_2Cu$ with about 50 volume percent $TiB_2$, particles. The $Al_2Cu$ intermetallic exhibits a melting temperature less than that of the 2XXX series aluminum alloy, but is strengthened to ceramic-like strengths via the $TiB_2$. This alloy is superior to other Al-based metal matrix composites which utilize SiC reinforcements since the high strength 2XXX aluminum matrix exhibits thermodynamic stability with the $Al_2Cu$ intermetallic matrix composite. As discussed previously, in conventional Al/SiC composites, Si is added to the aluminum matrix to promote chemical compatibility with the SiC particulates, which leads to a substantial decrease in the matrix melting temperature and a substantial decrease in the yield strength of the matrix. The aluminum matrix composite materials in accordance with the present invention thus exhibit increased strength and elevated temperature stability in comparison with prior art Al/SiC composites.

As a further example, an AA 5XXX series Al—Mg alloy may be reinforced with an intermetallic matrix composite comprising $Al_3Mg_2$ intermetallic with about 50 volume percent $TiB_2$ particulates.

In addition, steel alloys may be reinforced in accordance with the present invention with an intermetallic matrix composite of, e.g., FeAl intermetallic with about 50 volume percent TiC particles. The resultant composite possesses increased strength and elevated temperature capabilities, while maintaining satisfactory processability.

Figure 2:
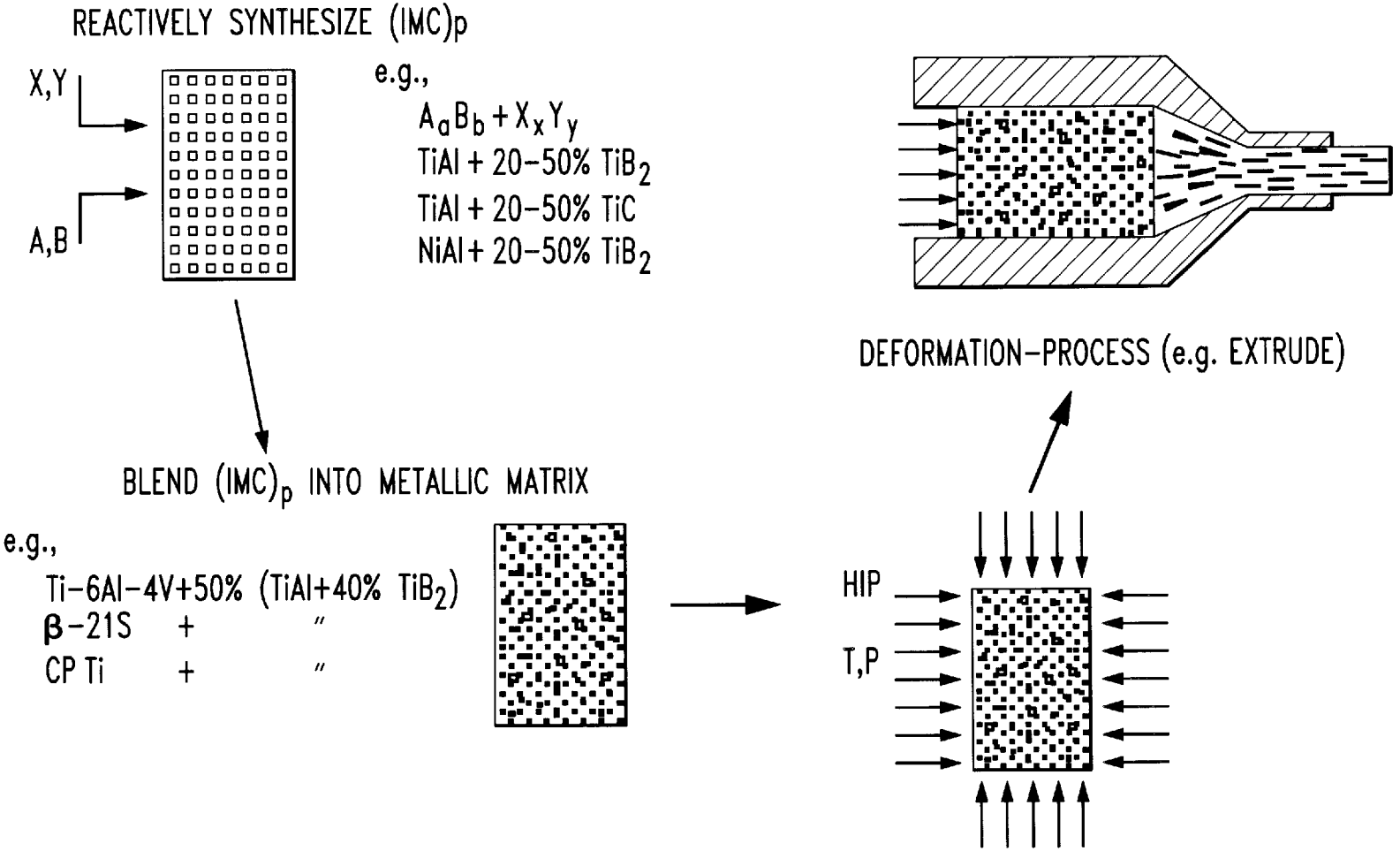
FIG. 2 is a schematic diagram illustrating the formation of a composite material in accordance with an embodiment of the present invention.

The composite materials of the present invention may preferably be made by powder metallurgical techniques wherein powders of the continuous matrix phase are mixed with powders of the composite reinforcement phase, followed by consolidation. FIG. 2 schematically illustrates one type of suitable powder metallurgy process wherein particles of a reactively synthesized intermetallic matrix composite reinforcement are blended with particles of a metallic matrix material, followed by hot isostatic pressing (HIPing) to consolidate the powders to thereby form a continuous metallic matrix around the composite reinforcements. While consolidation is achieved by HIPing in FIG. 2, it is to be understood that other types of consolidation using elevated temperature and/or elevated pressure may be used, such as sintering, pressing, hot pressing, cold isostatic pressing, extruding, forging, rolling and the like.

As shown in FIG. 2, once the final composite of the present invention is formed by consolidation, it may optionally be further processed by deformation techniques such as extrusion. While deformation by extrusion is illustrated in FIG. 2, it is to be understood that any other suitable type of deformation technique may be used such as forging, rolling, swaging and the like.

Alternatively, the consolidation step of the present invention may be performed simultaneously with the deformation process. For example, a green body comprising a mixture of the composite reinforcement and continuous metallic matrix powders may be consolidated by deformation processes such as extrusion, forging, rolling and the like. Such deformation processes may be carried out at ambient temperature, but are preferably performed at elevated temperatures.

Figure 3:
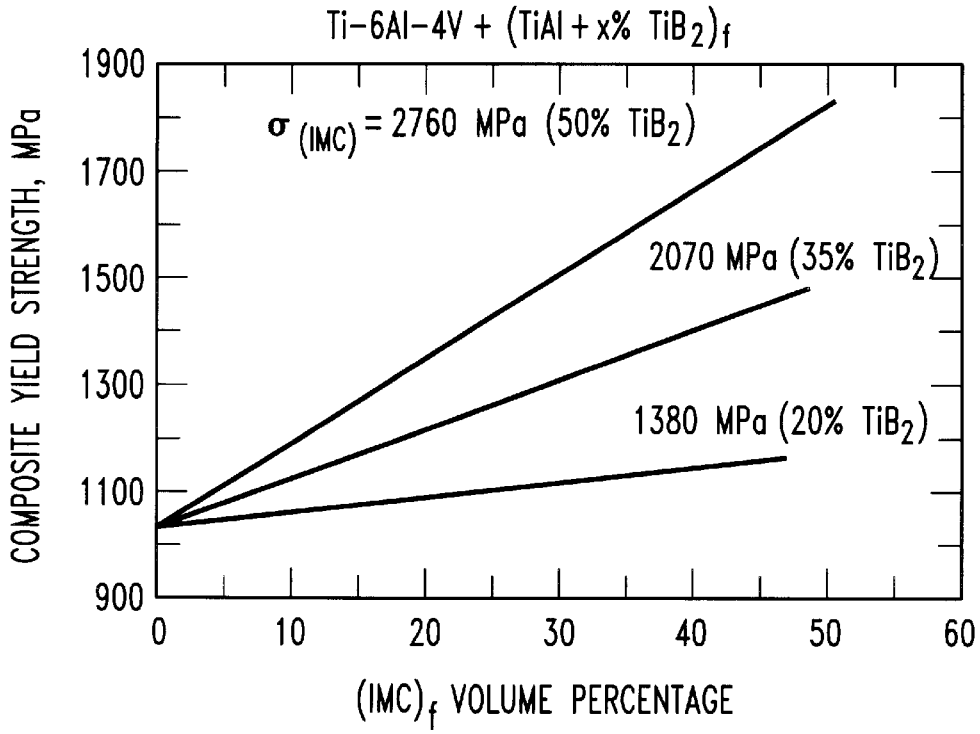
FIG. 3 is a graph of composite reinforcement volume percentage vs. composite yield strength illustrating projected yield strengths for various types and amounts of composite reinforcements in accordance with the present invention.

FIG. 3 illustrates predicted yield strengths for consolidated/deformed composite materials of the present invention for various ceramic loadings. The predictions of yield strengths in FIG. 3 are based on rule-of-mixtures calculations for discontinuous reinforcements in a Ti-6Al-4V matrix. The composite yield strength depends on the volume fraction of the intermetallic matrix composite within the continuous matrix ($IMC_f$), as well as the strength of the intermetallic matrix composite as determined by the loading of ceramic in the reinforcement. The yield strength predictions shown in FIG. 3 are based on an average composite reinforcement particle size of 75 micron (−200 mesh screen). While extremely favorable mechanical properties are illustrated in FIG. 3, it is noted that even higher yield strengths may be achieved as a result of deformation processing, as more fully described below.

The composite materials of the present invention may be prepared for deformation using conventional powder-based metallurgical techniques. While the matrix material may be provided directly in a fine-powder form, the intermetallic matrix composite typically requires comminutive processing, such as disk milling and the like, to reduce its size to a scale by which it can eventually impart effective strengthening to the continuous matrix. Specifically, preferred particulate size ranges for the composite reinforcements may range from about −20 to about −325 standard mesh sizes, and more preferably from about −100 to about −325 standard mesh sizes.

In accordance with the present invention, in-situ formed metallic matrix composites as disclosed in U.S. Pat. Nos. 4,710,348, 4,751,048, 4,772,452, 4,774,052, 4,915,902, 4,915,903, 4,915,908, 4,916,029, 4,916,030, 4,917,964, 4,985,202, 5,059,490 and 5,093,148 may be comminuted by any suitable means such as milling, grinding, crushing and the like to provide the discontinuous composite reinforcement phase. Alternatively, the discontinuous reinforcement phase may be provided directly by rapid solidification techniques such as those disclosed in U.S. Pat. Nos. 4,836,982, 4,915,905 and 5,015,534. Upon rapid solidification, the resultant composite may be of suitable size for use as a reinforcement, or may be further comminuted to the desired particulate size.

The composite reinforcement powders and metallic matrix powders of the appropriate sizes are blended in the determined proportions prior to their preparation for consolidation and/or deformation. Powder size may be selected in order to provide the desired interparticle spacing within the cross section of the final consolidated composite.

The temperature at which the deformation, e.g., extrusion, occurs may be controlled to provide the desired relative flow properties of the metallic matrix and the composite reinforcement particles. Commensurate deformation during co-extrusion depends on the relative flow stresses of the two components since load transfer between adjacent dissimilar particles is required for deformation to occur. One might expect that the flow stress exhibited by the unreinforced matrix component would be insufficient to commensurately deform the composite reinforcement. However, upon inspection of the temperature dependence of the homologous temperatures of a titanium matrix and those of near-γ TiAl and $Al_3Ti$, it is noted that high values (i.e., approaching 1) are attainable in the intermetallic matrices, and are in excess of that for Ti. That is, an extrusion temperature may be used whereby the relative flow stresses of both the titanium matrix and the intermetallic matrix composite are equal.

Figure 4:
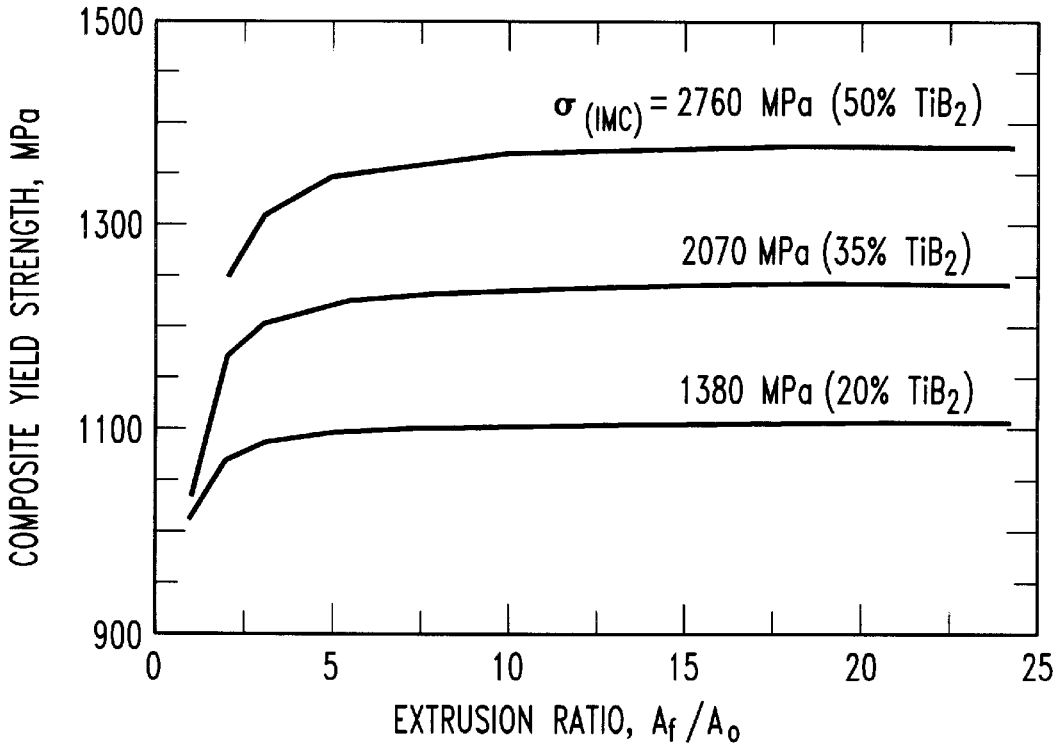
FIG. 4 is a graph of extrusion ratio vs. composite yield strength illustrating projected yield strengths for various types of composite reinforcements at various extrusion ratios in accordance with the present invention.

Extrusion ratio ($A_i/A_f$, where $A_i$, and $A_f$ are the initial and final cross-sectional areas of the extrusion, respectively) may also affect the aspect ratio of the deformation processed intermetallic matrix composite reinforcements, as well as establishing the spacing between reinforcements. Small reinforcement spacings in dislocation-containing matrices tend to lead to higher composite strengths. Extrusion ratios ranging from less than approximately 5:1 to greater than about 40:1 may be used in accordance with the preferred embodiment of the present invention, with ratios of from about 10:1 to about 30:1 being more preferred. FIG. 4 illustrates predicted composite yield strengths for various extrusion ratios and for various ceramic loadings for a Ti-6Al-4V continuous matrix reinforced with 20 volume % near-γ TiAl+$TiB_2$ composition.

Figure 5:
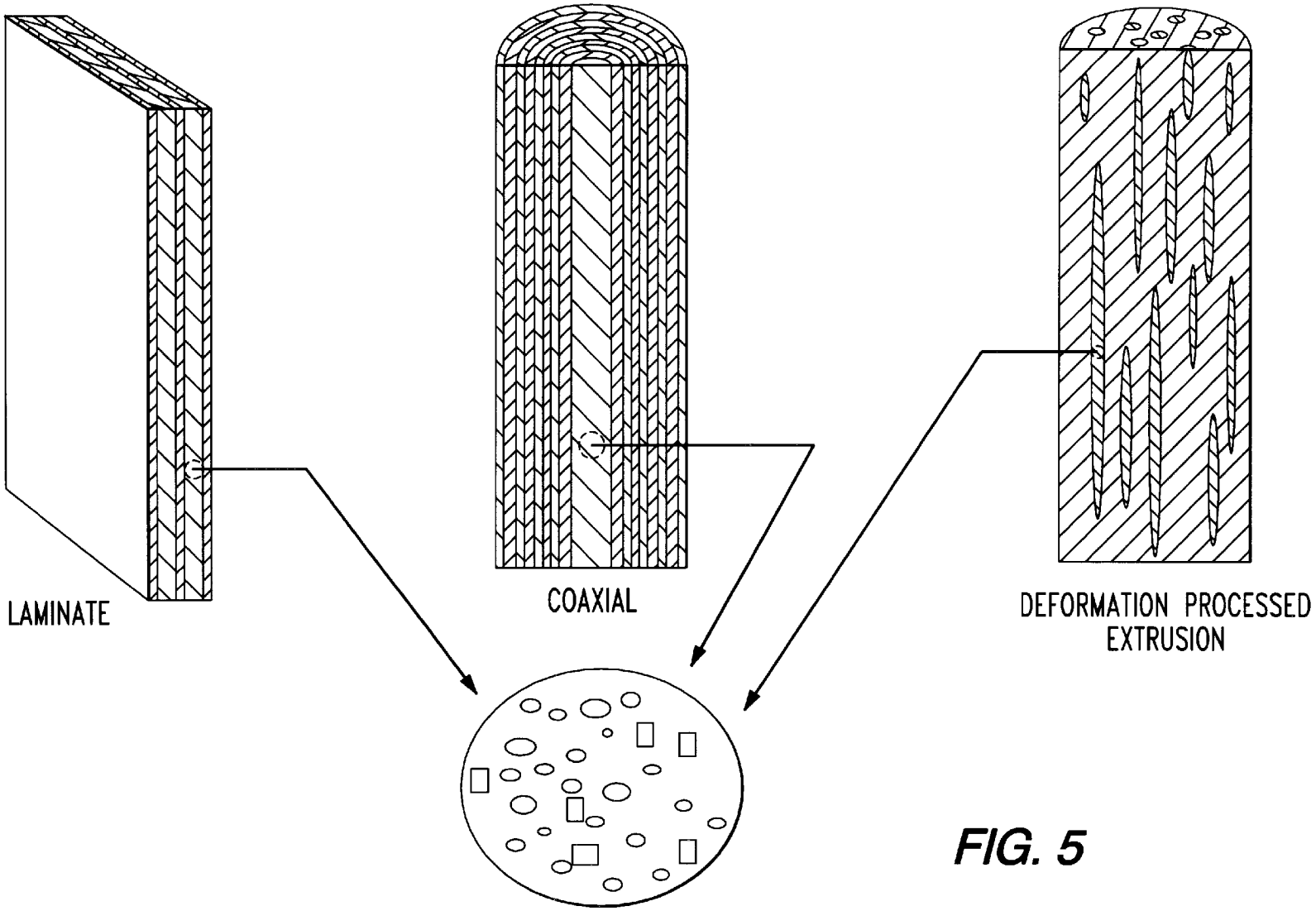
FIG. 5 is a partially schematic illustration of various product forms of the composite materials of the present invention.

In accordance with a preferred embodiment of the present invention, through the imposition of high temperature, powder-based extrusion an aligned, intermetallic matrix composite-reinforced continuous metal matrix composite can be created wherein the continuous metal matrix and the intermetallic matrix composite-reinforcement deform commensurately. Such a deformation-processed extrusion is illustrated in FIG. 5. The primary variables of processing by which the microstructure can be developed during extrusion are the reduction ratio and the processing temperature imposed. The latter is particularly influential in establishing the relative magnitudes of the strength and flow behavior of both the intermetallic matrix composite reinforcements and matrix components during co-extrusion.

While not intending to be bound by any particular theory, the deformation process of the preferred embodiment of the present invention is believed to produce an aligned in-situ microstructure through the commensurate deformation of the continuous metallic matrix. Even though the reinforcing entities are discontinuous in their distribution within the matrix, these composites may exhibit strengths which are significantly greater than rule-of-mixture predictions for conventional composites. Thus, the predicted composite yield strengths shown in FIG. 3, which are based on rule-of-mixture predictions, may be substantially higher for the deformation processed composites of the present invention. The origin of the improved strengthening may be due to the generation of geometrically necessary dislocations which evolve to accommodate strain incompatibility during deformation processing, the high degree of grain refinement and/or the evolution of texture.

Due to the unique properties of the intermetallic matrix composite reinforcements of the present invention in comparison with conventional ceramic-type reinforcements, several processing advantages are possible. Particular advantage is realized by processes that exploit the metal-like attributes of the intermetallic matrix composite to facilitate densification, reinforcement morphology, alignment and/or size.

For example, a blended mixture of composite reinforcement and metallic matrix powders may be placed in a metallic can and extruded at elevated temperature to effect consolidation and morphological alignment of the composite reinforcements. Processability and co-deformability of the blend may be established independently through the establishment of processing temperature of the composite reinforcement and metallic matrix components. A preferred method involves extrusion such that complete densification occurs between like and dissimilar components as obtained through the use of extrusion or drawing at reduction ratios of at least 7:1. A more preferred method uses higher extrusion ratios such that the composite reinforcement deforms commensurately with the matrix leading to reinforcement aspect ratios of 2 or greater. This may be achieved through selection of the intermetallic matrix melting temperature, ceramic loading, temperature of processing and extrusion/drawing conditions. A particularly preferred method involves extrusion at ratios greater than 10:1 such that aligned reinforcement aspect ratios of greater than 10 can be developed.

Forging may be used as the deformation process in accordance with an embodiment of the present invention. In this case, results similar to those obtained by extrusion may be achieved, except that as a consequence of forging the composite reinforcement assumes a disc-like morphology. Conditions which minimize the aspect ratio of the disc (defined as the height of a disc divided by its diameter) are preferred.

The present invention allows for the creation of composites with a broad range of microstructures, based upon the resulting spacing and aspect ratio of the intermetallic matrix composite reinforcement, as influenced by the initial size of the intermetallic matrix composite powder and the extent to which the composite is consolidated or deformed. The present invention also provides a thermodynamically stable composite microstructure by independently selecting an intermetallic matrix of known stability within a desired continuous metallic matrix. Furthermore, thermomechanically stable microstructures may be created by controlling the overall thermal expansion of the intermetallic matrix composite reinforcements through variances in the proportion of, e.g., low-expansion ceramic $TiB_2$ within the higher-expansion intermetallic and/or by controlling the percentage of composite reinforcement within the continuous metallic matrix.

While powder metallurgical techniques are currently preferred for the production of the present composites, it is to be understood that the composites may be made by other techniques such as contacting the intermetallic matrix composite reinforcements with molten matrix metal followed by solidification to provide the final composite material.

In accordance with one alternative embodiment of the present invention, a processing methodology may be used where metallic tubes are nested within one another, with enough room provided in between individual tubes such that an intermetallic matrix composite in the form of powder can be charged. The assemblage is then densified via conventional powder metallurgy techniques. Optionally, deformation processing may be used to simultaneously densify and/or to provide the desired morphological characteristics to the metal and the composite reinforcement. Such a configuration is illustrated as the coaxial product form in FIG. 5. This type of composite exhibits improved longitudinal and traverse strength as provided by the presence of the intermetallic matrix composite, and improved toughness, as provided by the metallic constituent.

Laminate composites may also be produced in accordance with another alternative embodiment of the present invention. In this case, the intermetallic matrix composite powder may be placed between alternating layers of metallic sheet. Optionally, the assemblage can be deformation processed by rolling or other techniques to improve the morphological character of the composite, or to promote a favorable compressive residual stress state in the intermetallic matrix composite phase. Such a configuration Is shown as the laminate product form in FIG. 5.

The following non-limiting examples are intended to illustrate various aspects of the present invention.

EXAMPLE 1

Figure 6:
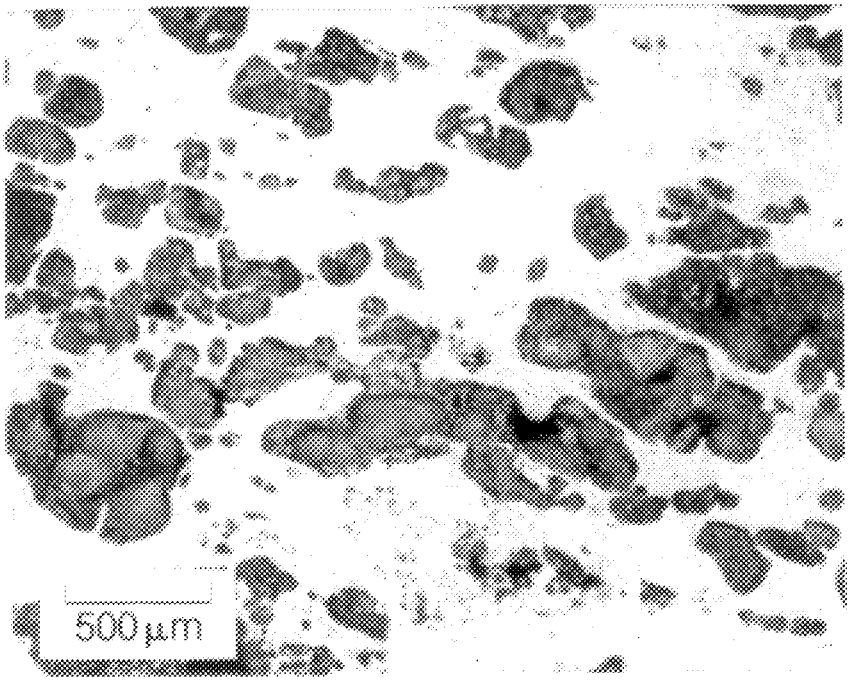
FIG. 6 is a photomicrograph of a composite material of the present invention.
Figure 7:
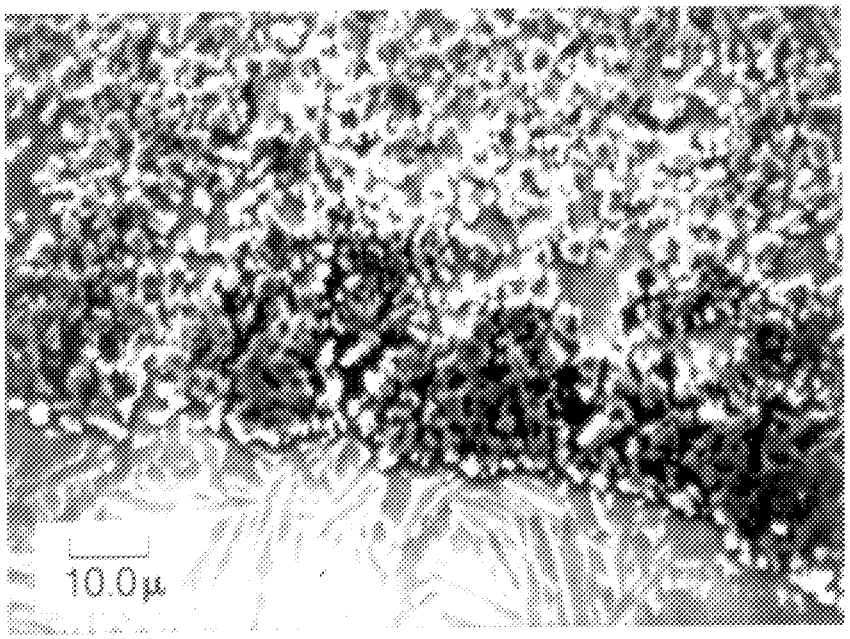
FIG. 7 is a photomicrograph of a composite material of the present invention showing the interface between an intermetallic matrix composite reinforcement particle and the continuous metallic matrix of the composite.

A powder mixture was formed by blending 3.4 grams of −100 mesh (particle diameter<150 micron) of commercially pure titanium powder (99.95% purity), 0.745 grams of −100/+325 (44 micron<particle diameter<150 micron) aluminum powder (99.99% purity), and 0.84 grams of −100 mesh crystalline boron (99.5% purity) together in a naphlene bottle on a ball-mill. The blended mixture was pressed in a unidirectional hydraulic press at 4 MPa pressure in a cylindrical die, thereby producing cylindrical compacts 5 grams in weight and 12 mm in diameter×14 mm in height. This procedure was repeated until approximately 500 grams of green compacts were produced. The compacts were placed in an induction field in groups of 5 and reactively synthesized to create in-situ intermetallic composites of overall composition Ti-47 atomic % Al+50 volume % $TiB_2$. The resulting product was reduced to −100 mesh powder by communition in a two-step process consisting of jaw crushing followed by disk milling. Powder sizing was effected by conventional screening analysis techniques. The 500 grams of intermetallic matrix composite was subsequently blended with 533 grams of prealloyed −35 mesh (<500 micron) Ti-6Al-4V PREP (spherical) powder. The blended powder was placed in a 7.3 cm inside diameter (schedule 40) canister constructed from CP Ti pipe with welded CP Ti end-caps. The canister was hermetically sealed by sealing the contents of the can under a reduced pressure of 30 mm of Hg. The resulting sealed container was hot isostatically pressed (HIPed) at 1170° C. for 4 hours under a pressure of 207 MPAa to produce a metal matrix composite of composition 50 volume percent continuous metallic component (Ti-6Al-4V) and 50 volume percent intermetallic matrix composite reinforcement (Ti-47Al+50 volume % $TiB_2$). A composite material produced in accordance with this example is shown in the photomicrograph of FIG. 6 taken at a magnification of 30×. The interface developed between the components is shown in FIG. 7, taken at a magnification of 900×.

EXAMPLE 2

Example 1 is repeated, except that an intermetallic matrix composite reinforcement of composition Ti-47Al+40 volume % $TiB_2$ is created by blending 3.4 grams of CP Ti powder with 0.9178 grams of aluminum powder and 0.700 grams of boron powder.

EXAMPLE 3

Examples 1 and 2 are repeated, with the exception that an intermetallic matrix composite reinforcement of composition Ti-62.5Al-12.5Cu ($[Al_{12}Cu]_3Ti$)+50 volume % $TiB_2$ is created by blending 2.6 grams of CP Ti with 1.08 grams of aluminum, 0.509 grams of copper (−100 mesh, 99.98% purity), and 0.82 grams of boron. This intermetallic matrix is of lower melting temperature than those described above, thereby providing improved consolidation efficiency at a given temperature.

EXAMPLE 4

Examples 1 and 2 are repeated, except that −100 mesh, 99.5% pure amorphous boron is substituted for the crystalline form. The resultant intermetallic matrix composite reinforcement is similar to those produced in the previous examples.

EXAMPLE 5

Examples 1 and 2 are repeated, except that the powder sizes are increased to −50 mesh (<297 micron), thereby contributing to improved economy of processing.

EXAMPLE 6

Examples 1 and 2 are repeated, except that the continuous metal matrix is comprised of CP titanium (−100 mesh, 99.95% purity).

EXAMPLE 7

Examples 1 and 2 are repeated, except that the continuous metal matrix is comprised of prealloyed β-21S (Ti-15Mo-2.7Nb-3Al-0.2Si in weight %) powder, −100 mesh.

EXAMPLE 8

Examples 1, 2, 6 and 7 are repeated, except that the intermetallic matrix composite reinforcement is subjected to more rigorous sizing following communition such that −200 mesh powder (<47 micron in diameter) is obtained for subsequent blending with the continuous metallic component. The smaller reinforcement size results in reduced spacing between the reinforcements.

EXAMPLE 9

Examples 1, 2, 6 and 7 are repeated, except that the final composite is subsequently reheated to 1150° C., held for 2 hours and deformation processed via extrusion at a reduction ratio at 14:1. This additional procedure results in deformation via elongation of the intermetallic matrix composite reinforcements, which results in improved mechanical properties.

EXAMPLE 10

Example 9 is repeated, except that an extrusion ratio of 20:1 is imposed, leading to deformed reinforcements of increased aspect ratio thereby providing improved mechanical properties.

EXAMPLE 11

Figure 8:
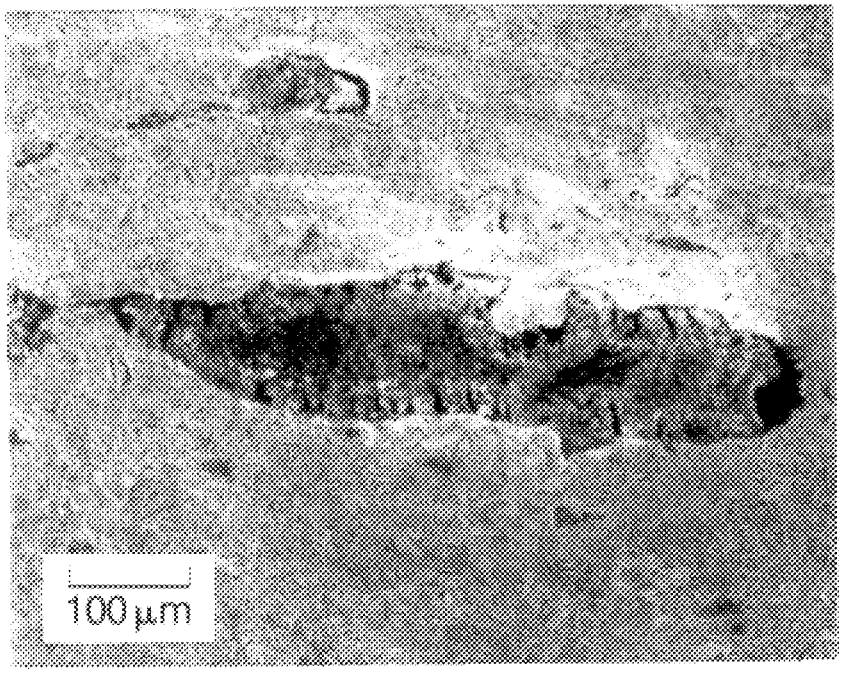
FIG. 8 is a photomicrograph of a composite material of the present invention that has been deformation processed, showing a degree of deformability in the reinforcement component.

Examples 1, 2, 6 and 7 are repeated, except that consolidation is effected by deformation processing, thereby eliminating the need for HIP consolidation and creating a more cost-effective manufacturing methodology. An extruded composite comprising a Ti-6Al-4V continuous matrix reinforced with Ti-47Al/$TiB_2$ elongated particulates produced in accordance with this example is shown in the photomicrograph of FIG. 8 taken at a magnification of 35×.

EXAMPLE 12

Examples 9 and 11 are repeated, except that deformation processing is effected by repeated rolling with a maximum per pass thickness reduction of 10%. The imposed processing results in a novel reinforcement morphology, providing improved properties under certain conditions.

EXAMPLE 13

Examples 9 and 11 are repeated, except that deformation processing is effected by isolthermal forging at 1150° C. at reduction ratios (initial height/final forged height) of 10:1. The imposed processing results in a novel reinforcement morphology leading to improved properties.

EXAMPLE 14

Examples 1 and 2 are repeated, except that a metal matrix composite is made by forming $Al_2Cu$+50 volume % $TiB_2$ intermetallic matrix composite reinforcement and blending within prealloyed 2XXX series aluminum alloy. The intermetallic matrix composite is synthesized by blending 1.13 grams of aluminum, 1.33 grams of copper, 1.753 grams of titanium and 0.79 grams of crystalline or amorphous boron, followed by compaction and reaction. The intermetallic matrix composite is similarly made into powder by crushing and grinding, blended with prealloyed 2024 aluminum powder, and HIPed at 400° C. for four hours at a pressure of 207 MPa.

EXAMPLE 15

Example 14 is repeated, except that the consolidated metal matrix composite is subsequently given a heat treatment of 550° C./1 hour +220° C./1 hour to create a desirable combination of ductility and strength in the precipitation-hardenable aluminum matrix.

EXAMPLE 16

Example 14 is repeated, except that the metal matrix composite is subsequently deformation processed by extrusion at 150° C. and a reduction ratio of 20:1, creating high aspect ratio reinforcements yielding improved mechanical properties.

EXAMPLE 17

Example 16 is repeated, except that the metal matrix composite is deformation processed by forging at 150° C. at a height reduction ratio of 10:1, creating disk-shaped reinforcements yielding improved mechanical properties.

EXAMPLE 18

Example 14 is repeated, except that consolidation is effected by deformation processing, thereby eliminating the need for HIP consolidation and producing a composite material with improved mechanical properties.

It is understood that the above description of the present invention is susceptible to considerable modification, change and adaptation by those skilled in the art, and that such modifications, changes and adaptations are intended to be considered within the scope of the present invention, which is set forth by the appended claims.

What is claimed is:

1. A method for making a composite material, the method comprising:

a) mixing metal, metal alloy or intermetallic powder with composite powder comprising an intermetallic matrix with ceramic particles dispersed therein; and b) consolidating the mixture to form a composite material comprising a continuous matrix having composite reinforcements dispersed therein.

2. The method of claim 1, wherein the mixture is consolidated by a deformation process selected from the group consisting of extruding, forging and rolling.

3. The method of claim 1, wherein the consolidated composite material is subsequently subjected to a deformation process selected from the group consisting of extruding, forging and rolling.

4. The method of claim 1, wherein the ceramic particulates are formed in-situ in the intermetallic matrix of the composite reinforcements, and are selected from the group consisting of refractory metal borides, carbides, nitrides, sulicides, sulfides and combinations thereof.

* * * * *

UNITED STATES PATENT AND TRADEMARK OFFICE

CERTIFICATE OF CORRECTION

PATENT NO. : 5,854,966

DATED : December 29, 1998

INVENTOR(S) : Stephen L. Kampe et al.

It is certified that error appears in the above-indentified patent and that said Letters Patent is hereby corrected as shown below:

On the title page, item [57]

the Abstract, line 11, change "sulicides" to -- silicides --.

Column 5, line 46, change "sulicides" to -- silicides --.

Column 11, line 46, change "Is" to -- is--.

Column 14, line 57, change "sulicides" to -- silicides --.

Signed and Sealed this

Twenty-third Day of November, 1999

*Attest:*

Q. TODD DICKINSON

*Attesting Officer*

*Acting Commissioner of Patents and Trademarks*